United States Patent [19]

Lord

[11] 4,442,852

[45] Apr. 17, 1984

[54] ULTRASONIC CLEANER APPARATUS

[76] Inventor: C. Dennis Lord, P.O. Box 47642, Dallas, Tex. 75247

[21] Appl. No.: 403,288

[22] Filed: Jul. 30, 1982

[51] Int. Cl.[3] ..... B08B 3/12

[52] U.S. Cl. ..... 134/135; 134/184

[58] Field of Search ..... 134/135, 184, 1

[56] References Cited

U.S. PATENT DOCUMENTS

| | | | |
|---|---|---|---|
| 2,699,149 | 1/1955 | Hammell | 134/115 R |
| 2,941,908 | 6/1960 | Logan | 134/1 |
| 2,994,330 | 8/1961 | Catlin et al. | 134/1 X |
| 3,280,828 | 10/1966 | Stiel | 134/135 X |
| 3,702,795 | 11/1972 | Wessells et al. | 134/184 X |
| 3,834,409 | 9/1974 | Kuparinen | 134/135 X |
| 3,871,395 | 3/1975 | Murry | 134/184 X |
| 3,964,926 | 6/1976 | Westphal | 134/135 X |

FOREIGN PATENT DOCUMENTS

| | | | |
|---|---|---|---|
| 54-19561 | 2/1979 | Japan | 134/184 |

*Primary Examiner*—Robert L. Bleutge

*Attorney, Agent, or Firm*—Kanz, Scherback & Timmons

[57] ABSTRACT

Ultrasonic cleaner apparatus is disclosed which includes a support housing, a cleaning tank supported by the housing and a transducer device physically attached to the bottom of the cleaning tank. A basket is configured to be capable of insertion into the cleaning tank. The basket includes a rim portion which rests on the support housing and maintains the bottom of the basket a predetermined distance above the bottom of the cleaning tank. The basket includes a predetermined number of cylindrical housings which are vertically oriented and are positioned around the inside of the basket. The cylindrical housings are configured to receive technical pens therein. A liquid level post projects upwardly from the bottom of the basket. Apertures in the bottom of the basket and the cylindrical housings allow cleaning solution and ultrasonic waves and energy to be transferred back and forth between the inside of the basket and the cleaning tank. A lid is configured to fit the top of the cleaning tank and also the top of the basket when the basket is positioned within the cleaning tank.

19 Claims, 5 Drawing Figures

ULTRASONIC CLEANER APPARATUS

DESCRIPTION

1. Technical Field

The present invention relates in general to cleaning. More particularly, this invention relates to ultrasonic cleaning, and specifically is directed to apparatus for the ultrasonic cleaning of technical pens and various other small parts.

Although the present invention is applicable for the ultrasonic cleaning of technical pens, various other type pens and parts of pens, various small parts, etc., it has been found to be particularly useful in the ultrasonic cleaning of technical pens used in drafting and drawing. Therefore, without limiting the applicability of the invention to "technical pens," the invention will be described in this environment.

Sound may be considered as vibrations produced by an object. Sound waves travel along the back-and-forth movement of the vibrating object that produces them. The speed of sound depends on the density and elasticity of the substance through which the sound travels. The denser the substance, the higher the speed. The more elastic the substance, the slower the speed. Sounds will travel approximately four times faster in water than in air. Ultrasound, or sound that vibrates at frequencies too high to be heard by humans (more than 20,000 vibrations per second), has many uses. Ultrasound can be used to sterilize instruments, drill metal, drill teeth, pasteurize milk, detect submarines and clean a great variety of items.

2. Background Art

One of the most common and widespread uses and application of ultrasonics is cleaning. The passage of ultrasonic waves through a liquid produces regions of compression and rarefaction. In the rarefaction regions, a "negative pressure" exists and the liquid is trying to tear itself apart. When it succeeds, it produces a cavity or bubble whose lifetime is extremely short. At the next region of compression, a small fraction of a second later, the cavity or bubble is squeezed, its walls are forced in upon the air or vapor it contains and the cavity or bubble may collapse. In that instant before the collapse, the pressure of gas or vapor within the cavity or bubble may reach several thousand times that of the atmosphere. When the cavity does collapse, it releases energy in the form of pressure and heat and powerful shock waves are formed. The formation of such bubbles in a liquid is called cavitation. Properly controlled, cavitation bubbles can be employed to knock unwanted softer material from harder surfaces.

Items now cleaned ultrasonically range from fine watch parts to heavy steel strips. The solvent, the size of the cleaning tanks, and the power and frequency of the ultrasonic waves, all vary depending upon the nature of the cleaning task. The dirty objects are suspended in a bath containing a suitable solvent and irradiated with ultrasonic waves of a suitable frequency and intensity to produce maximum cavitation. The shock waves produced during cavitation impinge upon the surface of the items and effectively scour them.

In the prior art ultrasonic cleaners used for the cleaning of small items, a common method of producing the ultrasonic waves is through the use of an electronic generator to supply electrical energy to a transducer. The transducer is mounted to a support structure which also houses and supports the electronic generator and the cleaning tank. The cleaning tank sits down and rests on the transducer and is supported by the support structure. A lid rests on the top or upper edge of the cleaning tank or on the edge of the support structure which surrounds the upper edge of the cleaning tank. Cleaning solution is introduced into the tank to the proper depth and the items to be cleaned are placed in the tank and the electronic generator is activiated. If the item is too large to place into the tank then the item must be taken apart and the individual pieces must be placed into the tank. After the cleaning process is completed, the individual pieces are retrieved from the cleaning solution in the tank.

The present invention as claimed is intended to provide a solution to various prior art deficiencies including the inefficient manner in which the transducer is coupled to the cleaning tank of the ultrasonic cleaner. The small prior art ultrasonic cleaners are configured such that the technical pens must be taken apart so that the nib portion may be cleaned of clogged ink. Parts of various technical pens must be cleaned separately or identified by tags etc., if cleaned together, so the parts can be placed back into the proper pen. The level of the cleaning solution is important in providing optimum performance of the ultrasonic cleaning unit and the prior art devices do not provide a means for easily and accurately determining the correct level of the cleaning solution. There is also the need to remove the individual parts from the cleaning solution with an individual's fingers or by the use of suitable tweezers.

DISCLOSURE OF INVENTION

The present invention provides apparatus for use in ultrasonic cleaning of technical pens and related small parts. The apparatus includes a support housing, a cleaning tank supported by the housing and a transducer means physically attached to the bottom of the cleaning tank. A basket is configured to be capable of insertion into the cleaning tank. The basket includes a rim portion which rests on the support housing and maintains the bottom of the basket a predetermined distance above the bottom of the cleaning tank. The basket includes a predetermined number of cylindrical housings which are vertically oriented and are positioned around the inside of the basket. The cylindrical housings are configured to receive technical pens therein. A liquid level post projects upwardly from the bottom of the basket. Apertures in the bottom of the basket and the cylindrical housings allow cleaning solution and ultrasonic waves and energy to be transferred back and forth between the inside of the basket and the cleaning tank. A lid is configured to fit the top of the cleaning tank and also the top of the basket when the basket is positioned within the cleaning tank. At the end of the cleaning cycle, the basket with any technical pens and any piece parts placed on the bottom of the basket are removed from the cleaning tank and the cleaning solution remains in the cleaning tank.

BEST MODE FOR CARRYING OUT THE INVENTION

Figure 1:
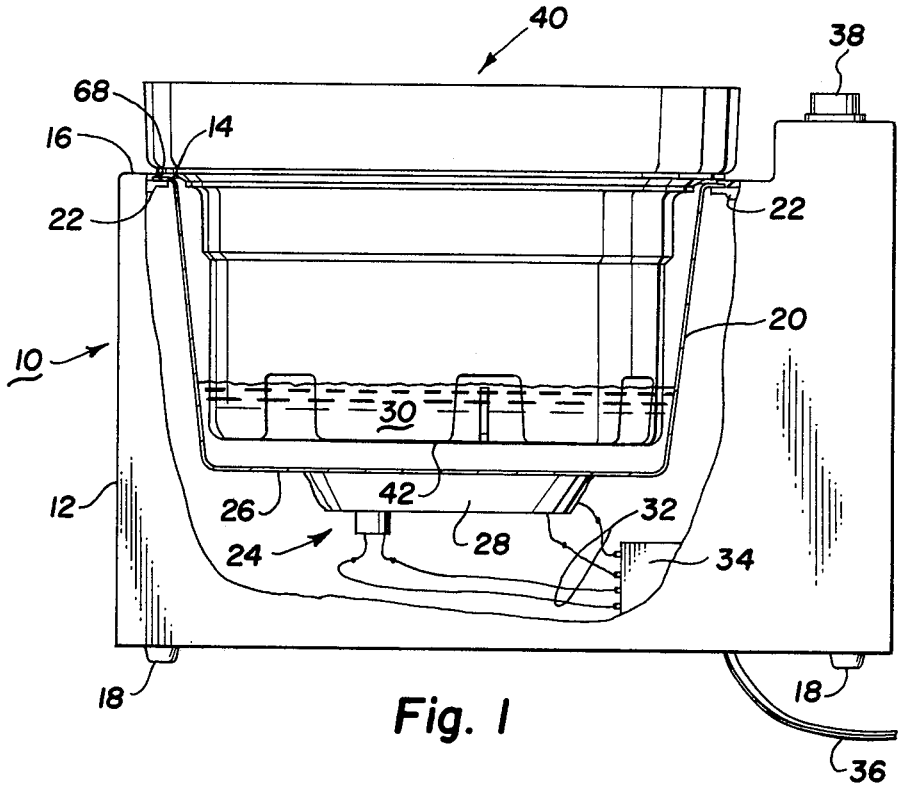
FIG. 1 is a simplified side elevational view of an ultrasonic cleaner, partially in section, incorporating the present invention.

Referring now to the drawing, and in particular, to FIG. 1, ultrasonic cleaner apparatus according to the present invention, is generally referred to by reference numeral 10. The ultrasonic cleaner apparatus 10 comprises a support cabinet or housing 12 with a circular aperture 14 of predetermined size in the top panel 16 thereof. Support cabinet 12 rests on four support feet 18 (only two of which are shown). Cylindrical cleaning tank 20 is held against top panel 16 by mounting means 22 and in axial alignment with aperture 14. In the preferred embodiment, cylindrical cleaning tank 20 is formed of stainless steel. Transducer and sensor means 24 is attached to the bottom surface 26 of cleaning tank 20 by epoxy cement 28 rather than just sitting or resting the bottom surface 26 of cleaning tank 20 down on the transducer and sensor means 24. By attaching the transducer and sensing means 24 with epoxy cement 28, there is a greater efficiency in the transfer of energy from the transducer and sensor means 24 in producing maximum cavitation in the cleaning solution 30 for a given value of excitation energy to the transducer and sensor means 24 with a resulting increase in the cleaning performed. Transducer and sensor means 24 is connected by cable 32 to electronic generator 34 for excitation therefrom. Electronic generator 34 obtains electrical power through cable 36 and on-off switch 38.

With reference to FIGS. 1-5, basket 40 is cylindrical in shape with a bottom 42. The bottom 42 has multiple apertures 44 therethrough which generally cover the area of bottom 42; a sampling of which is disclosed in FIG. 3. In the preferred embodiment, apertures 44 are square in shape, but it will be appreciated that apertures 44 could be round, rectangular, etc. The most important thing about the shape of the apertures 44 is their size. The apertures 44 must not be greater in size than the smallest part or item to be cleaned so the part or item will not fall through the basket 40 into the cleaning tank 20. In the preferred embodiment, apertures 44 are 0.1 inch square and are separated by 0.1 inch. Multiple cylindrical housings 46 are positioned around the bottom 42 and are oriented at right angles with respect to bottom 42. Each cylindrical housing 46 has an upper portion with an aperture or opening 48 therein. The lower portion of cylindrical housing 46 has an aperture or opening 49 therein which tapers downwardly to ledge 51. Ledge 51 contains an opening or aperture 50 therein which is smaller in diameter than aperture or opening 48. Lower opening or aperture 50 is fixed at a predetermined distance above bottom 42. The inside wall 52 of each cylindrical housing 46 continues on to bottom 42 while the outside wall 54 of each cylindrical housing 46 stops at lower opening or aperture 50. Each inside wall 52, between lower opening or aperture 50 and bottom 42, contains an aperture 56 therethrough. In the preferred embodiment, aperture 56 is rectangular in shape and has a vertical orientation. In the preferred embodiment, there are seven cylindrical housings 46 positioned equidistance around bottom 42 and against wall 58 of basket 40. In the preferred embodiment, each cylindrical housing, upper opening or aperture 48 and lower opening or aperture 50 are configured to support and hold a technical pen 60 with the writing portion or end 62 of technical pen 60 projecting through lower opening or aperture 50 and supported above bottom 42.

The upper portion of basket 40 has a rim portion 64 which is larger in circumference and diameter than the lower portion of basket 40. Basket 40 is of a predetermined size such that the basket 40 may be inserted into cleaning tank 20 such that surface 66 rests and is supported by the upper surface 68 of support cabinet 12 just outwardly from aperture 14. Bottom 42 of basket 40 is positioned at least ¼ inch above the bottom 26 of cleaning tank 20. Bottom 42 of basket 40 has a liquid level post 70 projecting upwardly therefrom into the interior volume of basket 40.

Figure 2:
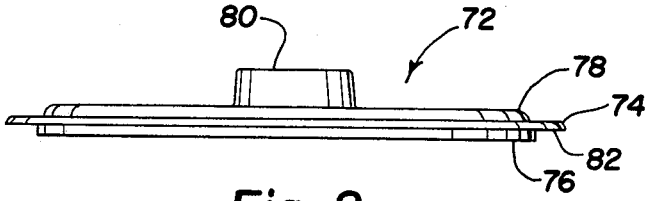
FIG. 2 is a simplified side elevational view of a cover means of the present invention.
Figure 3:
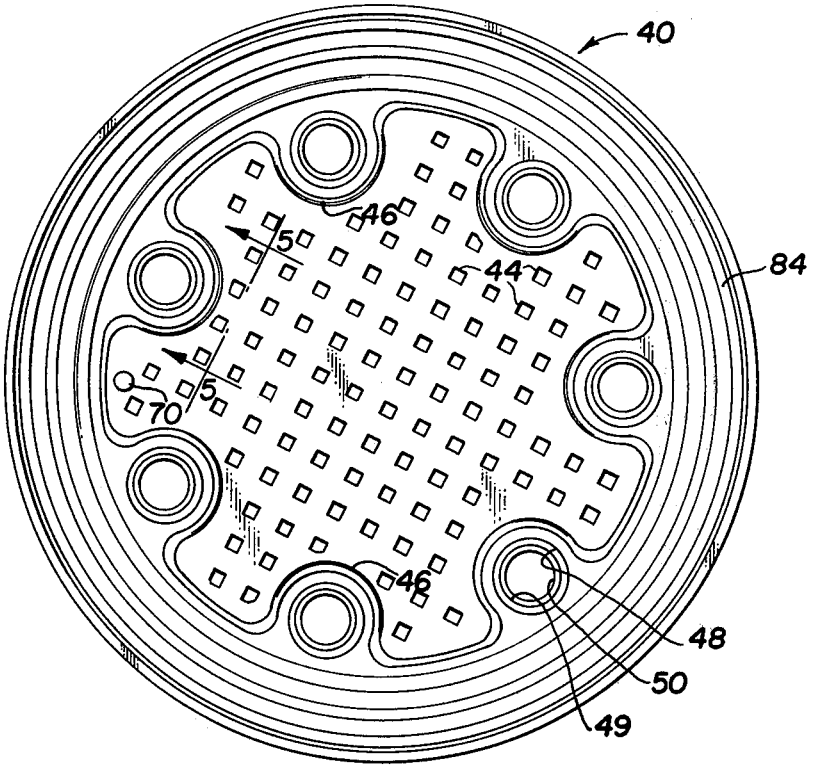
FIG. 3 is a simplified top plan view of the present invention.

With reference to FIG. 2, lid or cover 72 is disclosed and includes a flange portion 74, a lower portion 76, an upper portion 78 and a handle 80 projecting upwardly from upper portion 78. Lid 72 is sized or dimensioned such that it may be used as a cover for cleaning tank 20 or for basket 40. When lid 72 is used as a cover for cleaning tank 20, surface 82 of flange portion 74 rests on upper surface 68 and lower portion 76 projects downwardly into cleaning tank 20. When lid 72 is used as a cover for basket 40, surface 82 of flange portion 74 rests on upper surface 84 of basket 40 and lower portion 76 projects downwardly into basket 40.

Figure 5:
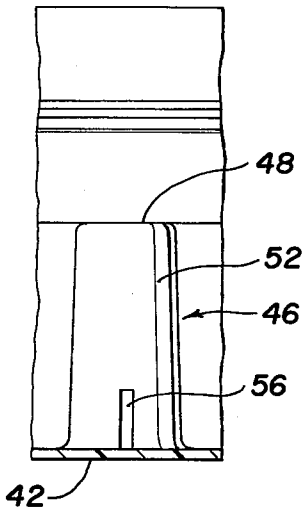
FIG. 5 is a simplified side elevational view taken along lines 5—5 of FIG. 3.
Figure 4:
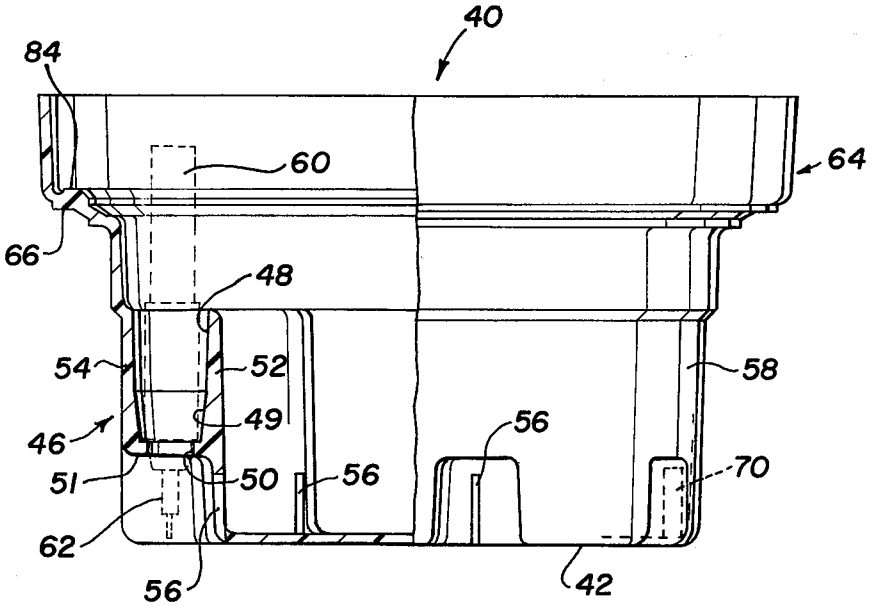
FIG. 4 is a simplified side elevational view, partially in section, of the present invention.

With reference to FIG. 5, one of the cylindrical housings 46 is shown with aperture 56 shown in wall 52.

In operation, basket 40 is inserted into cleaning tank 20 with surface 66 of rim portion 64 resting on upper surface 68 of support cabinet 12. In the preferred embodiment, up to seven different technical pens 50 of various brands and designs are inserted into the cylindrical housings 46 in a vertical orientation with the writing portion or ends 62 pointed downwardly. It is not necessary to disassemble the pens 60 into piece parts. Cleaning solution 30 is added into basket 40 until the cleaning solution 30 reaches the top of liquid level post 70. The cleaning solution 30 flows freely between basket 40 and cleaning tank 20 through apertures 44 in bottom 42 and through apertures 56 in cylindrical housings 46. Also, small piece parts, in addition to pens 60, may be placed in basket 40 by laying the small piece parts on the bottom 42 of basket 40. Obviously the lid or cover 72 cannot be used with the ultrasonic cleaner apparatus 10 when cleaning the assembled pens 60 since the pens 60 protrude upwardly out of basket 40. The ultrasonic cleaner apparatus 10 is activated by positioning the on-off switch in the on position. The transducer and sensor means 24 causes maximum cavitation and the pens 60 and any piece parts are efficiently and thoroughly cleaned. All the dried ink clogging the pens 60 is removed without the need to disassemble the pens 60. After the cleaning has been completed and the ultrasonic cleaner appartus 10 has been shut off, the pens 60 may be lifted from their position in their particular cylindrical housing 46 or the basket 40 may be lifted from the cleaning tank 20. Upon lifting the basket 40 from the cleaning tank 20, the cleaning solution 30 remains in the cleaning tank 20 and any small parts which were cleaned may be removed from basket 40 without the need to fish them from the cleaning solution 30 with fingers or tweezers.

It will be appreciated that the invention provides an improved apparatus for the ultrasonic cleaning of technical pens and small piece parts. The invention allows the technical pens to be placed into, cleaned and withdrawn from the cleaning apparatus, without having to touch the cleaning solution. The user has the choice of leaving the entire pen upright in the basket or only the writing portion or ends which actually houses the parts which houses the clogged ink. Because the cleaning is performed with the pens in a vertical orientation, it is easy to distinguish one particular pen from another and allows for quick identification of different technical pens. In addition, there is ample room on the bottom of the basket for miscellaneous pieces and parts which are retrieved by lifting the basket upwardly and let the cleaning solution drain out through the apertures in the basket.

Thus it is apparent that there has been provided in accordance with this invention, an ultrasonic cleaner apparatus that substantially incorporates the advantages set forth above. Although the present invention has been described in conjunction with specific forms thereof, it is evident that many alternatives, modifications, and variations will be apparent to those skilled in the art in light of the foregoing disclosure. Accordingly, this description is to be construed as illustrative only and is for the purpose of teaching those skilled in the art the manner of carrying out the invention. It is understood that the forms of the invention herewith shown and described are to be taken as the presently preferred embodiments. Various changes may be made in the shape, size and arrangements of parts. For example, equivalent elements may be substituted for those illustrated and described herein, parts may be reversed, and certain features of the invention may be utilized independently of the use of other features of the invention. It will be appreciated that the various modifications, alternatives, variations, etc., may be made without departing from the spirit and scope of the invention as defined in the appended claims.

I claim:

1. Apparatus for ultrasonic cleaning, said apparatus comprising:

(a) a support housing;

(b) an aperture of predetermined shape and size formed in a top surface of said support housing;

(c) a cleaning tank positioned within said aperture and supported from said support housing, said cleaning tank being configured to support a cleaning solution to a predetermined depth in said cleaning tank, said cleaning tank including a bottom portion lying substantially in a horizontal plane;

(d) transducer means physically attached to the exterior bottom surface of said bottom portion of said cleaning tank by fastening means;

(e) excitation means connected to said transducer means for excitation thereof to produce cavitation in said cleaning solution and provide resultant cleaning of predetermined items placed in said cleaning tank; and (f) a basket-type container configured to be inserted into the cleaning tank while being supported by the top surface of said support housing.

2. The apparatus of claim 1 wherein said basket-type container and said transducer means are configured and positioned to be coaxial with said aperture of predetermined shape and size formed in a top surface of said support housing.

3. The apparatus of claim 2 wherein said basket-type container includes a bottom portion with apertures formed therein.

4. The apparatus of claim 3 wherein said basket-type container is configured such that said bottom portion is a predetermined distance above a bottom surface of said cleaning tank.

5. The apparatus of claim 3 wherein said basket-type container includes a predetermined number of cylindrical housings positioned within said container and oriented at right angles with respect to said bottom portion.

6. The apparatus of claim 5 wherein said cylindrical housings are configured to support technical pens therein in a vertical orientation such that the writing portions of said pens are immersed in said cleaning solution to a predetermined depth, said writing portions of said pens being positioned between an inside surface of said cleaning tank and an outside surface of said basket-type container.

7. The apparatus of claim 1 wherein said transducer means is attached by epoxy cement.

8. The apparatus of claim 3 further including means attached to said bottom portion of said basket-type container to provide an indication of the optimum level of cleaning solution.

9. The apparatus of claim 8 wherein said indicating means includes a post protruding upwardly from said bottom portion.

10. The apparatus of claim 5 further including an aperture in a sidewall of each cylindrical housing.

11. The apparatus of claim 2 further including a cover means operatively configured to operate as a lid for the basket-type container when said container is positioned within said cleaning tank and to operate as a lid for the cleaning tank when the basket-type container is not positioned within said cleaning tank.

12. Apparatus to be used in conjunction with an ultrasonic cleaner mechanism which includes a support housing and a cleaning tank supported therein, said apparatus comprising:

a basket-type container configured to be inserted into said cleaning tank while being supported by a top surface of said support housing, said container including a bottom with apertures formed therein.

13. The apparatus of claim 12 wherein said basket-type container is configured such that said bottom portion is a predetermined distance above a bottom surface of said cleaning tank.

14. The apparatus of claim 12 wherein said basket-type container includes a predetermined number of cylindrical housings positioned within said container and oriented at right angles with respect to said bottom portion.

15. The apparatus of claim 14 wherein said cylindrical housings are configured to support technical pens therein in a vertical orientation such that the writing portions of said pens are immersed in a cleaning solution held in said cleaning tank, said writing portions of said pens being positioned between an inside surface of said cleaning tank and an outside surface of said basket-type container.

16. The apparatus of claim 15 further including means attached to said bottom portion of said basket-type container to provide an indication of the optimum level of said cleaning solution.

17. The apparatus of claim 16 wherein said indicating means includes a post protruding upwardly from said bottom portion.

18. The apparatus of claim 15 further including an aperture in a sidewall of each cylindrical housing.

19. The apparatus of claim 12 further including a cover means operatively configured to operate as a lid for the basket-type container when said container is positioned within said cleaning tank and to operate as a lid for the cleaning tank when the basket-type container is not positioned within said cleaning tank.

* * * * *